US008763326B2

(12) United States Patent
Takeshima

(10) Patent No.: US 8,763,326 B2
(45) Date of Patent: Jul. 1, 2014

(54) BUILDING STRUCTURE

(76) Inventor: Ichiro Takeshima, Tokyo (JP)

( * ) Notice: Subject to any disclaimer, the term of this patent is extended or adjusted under 35 U.S.C. 154(b) by 292 days.

(21) Appl. No.: 12/449,798

(22) PCT Filed: Jul. 17, 2007

(86) PCT No.: PCT/JP2007/064083

§ 371 (c)(1),
(2), (4) Date: Aug. 27, 2009

(87) PCT Pub. No.: WO2009/011029

PCT Pub. Date: Jan. 22, 2009

(65) Prior Publication Data

US 2010/0132284 A1 Jun. 3, 2010

(51) Int. Cl.
*E04H 1/04* (2006.01)

(52) U.S. Cl.
USPC ..... 52/236.1; 52/79.4; 52/81.1

(58) Field of Classification Search
CPC ..... E04B 1/34815; E04B 2001/0092; E04H 1/02
USPC ..... 52/79.3, 79.4, 79.12, 81.1, 81.2, 81.3, 52/81.4, 96, 236.1, 653.1
See application file for complete search history.

(56) References Cited

U.S. PATENT DOCUMENTS 2,886,855 A * 5/1959 Petter ..... 52/79.4
D191,438 S * 10/1961 Paulson ..... D25/4
3,152,366 A * 10/1964 McCrory et al. ..... 52/79.4
3,791,080 A * 2/1974 Sjoberg ..... 52/79.4
4,075,813 A * 2/1978 Nalick ..... 52/745.07
4,186,533 A * 2/1980 Jensen ..... 52/184
(Continued)

FOREIGN PATENT DOCUMENTS

FR 2248380 * 6/1975
JP 48-95011 A 12/1973
JP 3-9810 B2 1/1991
JP 9-158312 A 6/1997

OTHER PUBLICATIONS

International Search Report of International Application No. PCT/JP2007/064083, Aug. 22, 2007.

*Primary Examiner* — Jeanette E Chapman
*Assistant Examiner* — James Buckle, Jr.
(74) *Attorney, Agent, or Firm* — Shlesinger, Arkwright & Garvey LLP

(57) ABSTRACT

A building structure includes a hexagonal grid in a vertical plane to thereby be structurally strong and solid, and has a variety of whole shapes. The building structure has a whole shape formed by connecting at least horizontally a plurality of unit spaces (10) each in the shape of a polygonal prism having a pair of end faces (T, W) and a plurality of side faces (S), and includes: a main hexagonal frame (1A, 1B, 1C) standing in each outdoor side face; an edge beam (2A1, 2A2, 2B1, 2C1, 2C2, 2D1, 3A, 3B, 3C) arranged at the edge of the upper end face (T) of each unit space; an indoor pillar (4A, 4B) arranged on each indoor side among both sides of the side faces (S) of each unit space, in which: the upper and lower sides of the main hexagonal frame are located on the upper and lower sides of the side face, respectively, and left and right bend portions (1A7, 1A8) of the main hexagonal frame are located on the left and right sides of the side face, respectively; and the main hexagonal frame, the edge beam and the indoor pillar are joined to each other.

10 Claims, 7 Drawing Sheets

(56) References Cited

U.S. PATENT DOCUMENTS

| | | | | | |
|---|---|---|---|---|---|
| 4,335,558 | A | * | 6/1982 | Caldwell et al. | 52/13 |
| 4,480,414 | A | * | 11/1984 | Tschudy et al. | 52/82 |
| 4,546,583 | A | * | 10/1985 | Hussar | 52/236.1 |
| 4,872,625 | A | * | 10/1989 | Filley | 244/159.4 |
| 4,903,452 | A | * | 2/1990 | Huang | 52/646 |
| 5,426,900 | A | * | 6/1995 | Springer | 52/79.1 |
| 5,560,151 | A | * | 10/1996 | Roberts | 52/81.1 |
| 6,033,750 | A | * | 3/2000 | Aladimi | 428/38 |
| 6,101,769 | A | * | 8/2000 | Hamill | 52/167.1 |
| 2002/0116879 | A1 | * | 8/2002 | Lindsley | 52/79.1 |
| 2003/0167702 | A1 | * | 9/2003 | Davies | 52/81.1 |

* cited by examiner

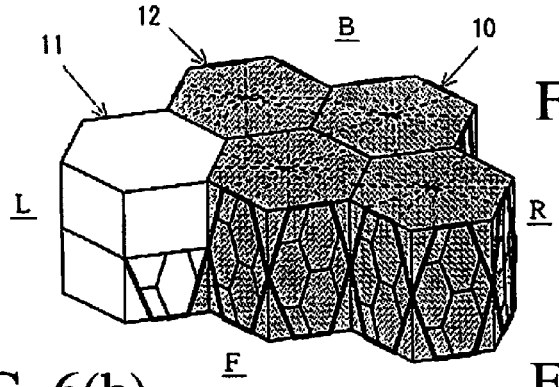
FIG. 6(a)
FIG. 6(b)
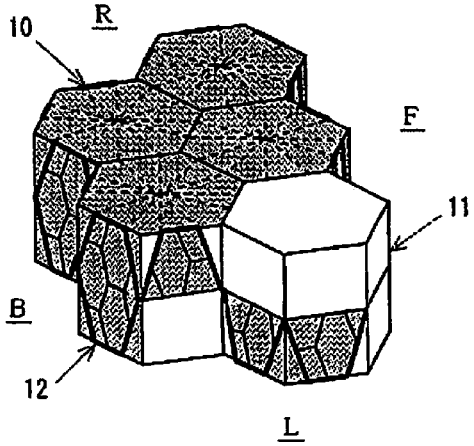
FIG. 6(c)
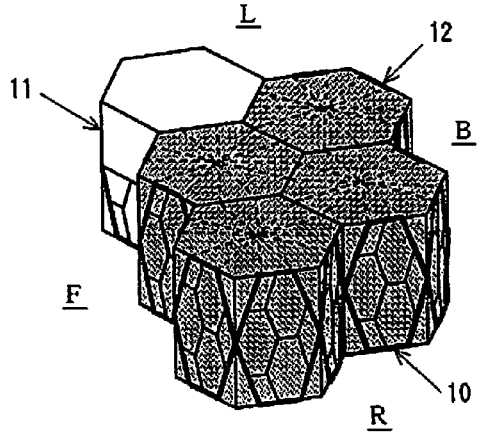
FIG. 6(d)
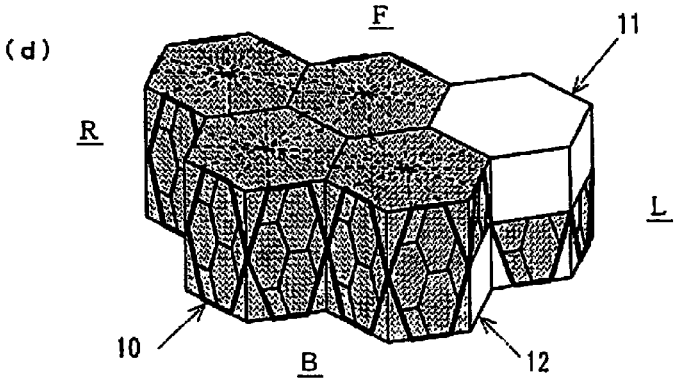

BUILDING STRUCTURE

RELATED APPLICATIONS

This is a national stage application of PCT/JP2007/064083,filed Jul. 17, 2007, hereby incorporated by reference.

BACKGROUND OF THE INVENTION

1. Field of the Invention

The present invention relates to a building structure which has a whole shape formed by connecting unit spaces each having a polygonal-prism shape at least horizontally and includes a hexagonal frame incorporated as a structural member.

2. Description of the Related Art

In general, a conventional building structure has a Rahmen frame formed by connecting straight pillars and horizontal beams into a three-dimensional grid shape, and occasionally, has a frame formed by connecting triangles or hexagons as unit grids.

Particularly, a structure formed by connecting hexagonal frames into a honeycomb shape is long known to be strong and solid. As the hexagonal-frame structure, there are some examples (Patent Documents 1 to 3) in which hexagonal frames are connected in a horizontal plane to form a honeycomb structure while a vertical connection is made by straight pillars. However, the structures according to Patent Documents 1 to 3 have no honeycomb structure in a vertical plane, though having a honeycomb structure in a horizontal plane.

The honeycomb structure has an advantage in that forces applied to a building from various directions can be easily converted into axial forces of beams or pillars. Some structural analyses verify that if given an equal horizontal load, a building having a honeycomb structure in a vertical plane produces weaker deformation and bending-moment stresses than a building having a common Rahmen frame does.

On the other hand, a trussed structure formed by connecting triangular frames is more frequently employed for a dome frame according to Patent Document 4 than for a tube frame.

Herein, Patent Documents 1, 2, 3 and 4 are Japanese Patent Laid-Open Publication No. 5-112984, Japanese Patent Laid-Open Publication No. 5-112987, Japanese Patent Laid-Open Publication No. 9-60301 and Japanese Patent Laid-Open Publication No. 2000-110243, respectively.

Taking the above into account, a building having a honeycomb structure in a vertical plane is expected to have a high stability and an excellent earthquake proof.

In terms of the whole shape of a building, a high-rise or super high-rise building is generally relatively simple because its whole shape extending in the vertical directions requires an excellent earthquake proof or a great wind resistance.

In contrast, low-rise and medium-rise (e.g., two to eight-story) buildings vary in whole shape and some are practically constructed. For example, there is a building having a complex, delicately-uneven contour in plan view, or a building having diverse contours for each story layer.

DISCLOSURE OF THE INVENTION

It is an object of the present invention to provide a building structure having a hexagonal frame and/or a honeycomb shape in a vertical plane to thereby be structurally strong and solid, and having a variety of whole shapes.

A building structure according to the present invention basically has a whole shape formed by connecting a plurality of unit spaces each in a polygonal-prism shape at least horizontally. The building structure is constructed by placing and joining a predetermined structural member (frame, beam, pillar) onto each side and/or each face of each unit space constituting the whole shape. Herein, the "unit space" itself is a virtual concept for defining the position of each structural member and the whole shape of a building.

The unit space having a polygonal-prism shape has a pair of upper and lower end faces and a plurality of side faces. The polygonal prism may preferably be a hexagonal prism, but it maybe a pentagonal prism, a quadrangular prism or a triangular prism. Two unit spaces horizontally adjacent to each other are connected in such a way that they share a side face facing each other, and if vertically adjacent to each other, two unit spaces share an end face facing each other.

A building structure according to an aspect of the present invention includes a main hexagonal frame standing in each outdoor side face among the side faces of each unit space and further includes an edge beam arranged in the place not occupied by a member of the main hexagonal frame at the edge of the upper end face of each unit space. In other words, either the edge beam or the member of the main hexagonal frame is arranged at the edge of the upper end face of each unit space.

The building structure still further includes an indoor pillar arranged on each indoor side among the left sides and right sides of the side faces of each unit space, and the indoor pillar is arranged at each indoor corner of each unit space.

An upper side and a lower side of the main hexagonal frame are located on an upper side and a lower side of the outdoor side face, respectively, and left and right bend portions of the main hexagonal frame are located on a left side and aright side of the outdoor side face, respectively.

The main hexagonal frame, the edge beam and the indoor pillar are joined to each other.

In a building structure according to another aspect of the present invention, the main hexagonal frame is provided inside with one or a plurality of sub-hexagonal frames similar to the main hexagonal frame, and each sub-hexagonal frame is joined to the main hexagonal frame in any vertex position of the main hexagonal frame.

In a building structure according to still another aspect of the present invention, a plurality of sub-hexagonal frames arranged inside of the main hexagonal frame are joined together into a honeycomb shape and fitted into the main hexagonal frame.

A building structure according to still another aspect of the present invention further includes an indoor main hexagonal frame standing in each of one or a plurality of indoor side faces among the side faces of each unit space.

In a building structure according to still another aspect of the present invention, each unit space is provided with a plurality of inner beams horizontally arranged across the unit space. Besides, a slab may be provided on the inner beams. In addition, in one or a plurality of unit spaces, the inner beams and the slab may be arranged partly in the whole of a horizontal plane inside of each unit space.

In a building structure according to still another aspect of the present invention, the unit space includes two story layers or three story layers.

The building structure according to the present invention has a whole shape formed by connecting unit spaces each in a polygonal-prism shape at least. Therefore, from the polygonal prism as a starting point, polygonal prisms can be horizontally connected in the directions of the same number as the side faces of the polygonal prism. In the vertical direction, a polygonal prism can be connected onto the upper end face of the polygonal prism as a starting point. The directions and number of connections in the horizontal directions and the number of connections in the vertical direction are basically optional, thereby varying the whole shape arbitrarily. The polygonal prism may be any of a hexagonal prism, a pentagonal prism, a quadrangular prism and a triangular prism, thereby enlarging the whole-shape diversity range.

The building structure according to the present invention includes as the basic form the main hexagonal frames arranged in all the outdoor side faces, the edge beam or the member of the main hexagonal frame arranged at the edge of the upper end face of each unit space, and an indoor pillar arranged on each indoor side among the left sides and right sides of the side faces of each unit space, and the indoor pillar arranged at each indoor corner of each unit space. Besides, the main hexagonal frame, the edge beam and the indoor pillar are joined to each other.

The thus formed building structure is characterized in that particularly, the peripheral faces are supported by only diagonal pillars and horizontal beams without straight pillars. The structure having only such diagonal pillars and horizontal beams in a vertical plane has advantages in that forces applied thereto from various directions can be converted into axial forces of the pillars and the beams more easily than a common Rahmen structure and in that the structure produces weaker deformation and bending-moment stresses than a common Rahmen structure, thereby making the building structure according to the present invention more stable and more earthquake resistant.

Particularly, the unit space is a hexagonal prism to thereby form a honeycomb shape in plan view and the unit space is a triangular prism to thereby form a truss shape in plan view, thereby obtaining a strong and solid structure in a horizontal plane in the case of a hexagonal or triangular prism. Besides, if the unit space is a hexagonal prism, the indoor space is larger than if it is a triangular prism.

In the building structure according to the present invention, the main hexagonal frame includes one or a plurality of sub-hexagonal frames arranged inside at vertex positions thereof, thereby enlarging the rigid zone around each vertex to make the structure stronger and solider. A plurality of sub-hexagonal frames are joined together into a honeycomb shape and fitted into the main hexagonal frame, thereby making the structure still stronger and solider.

In the building structure according to the present invention, the main hexagonal frame may be provided in an indoor side face of each unit space. Hence, the indoor main hexagonal frame supports the building structure, thereby strengthening the whole thereof.

In the building structure according to the present invention, each unit space may be provided with a plurality of inner beams horizontally arranged across the unit space and a slab may be provided on the inner beams. The inner beams and the slab form a floor or a ceiling (roof floor) of the unit space. Further, the inner beams and the slab can be arranged midway in the height directions, thereby dividing the unit space into two story layers or three story layers.

If the unit space includes two story layers, two such unit spaces are heaped to thereby construct a building having four story layers and if the unit space includes three story layers, two such unit spaces are heaped to thereby construct a building having six story layers. Alternatively, two unit spaces having the same size and two and three story layers, respectively, can be combined together.

The building structure according to the present invention is formed by successively connecting unit spaces basically having substantially the same structure, thereby reducing the kinds of component members and enhancing the workability, leading cuts in production and construction costs. The building structure is especially suitable for low-rise and medium-rise buildings.

In addition, the inner beams and the slab may be arranged partly in the whole of a horizontal plane inside of the unit space, thereby forming an open ceiling, a staircase, a skylight or the like.

BRIEF DESCRIPTION OF THE DRAWINGS

FIGS. 6A to 6D are perspective views seen from four directions showing a whole shape of a building structure according to the present invention.

DETAILED DESCRIPTION OF THE INVENTION

Embodiments of the present invention will be below described with reference to the drawings.

Figure 1:
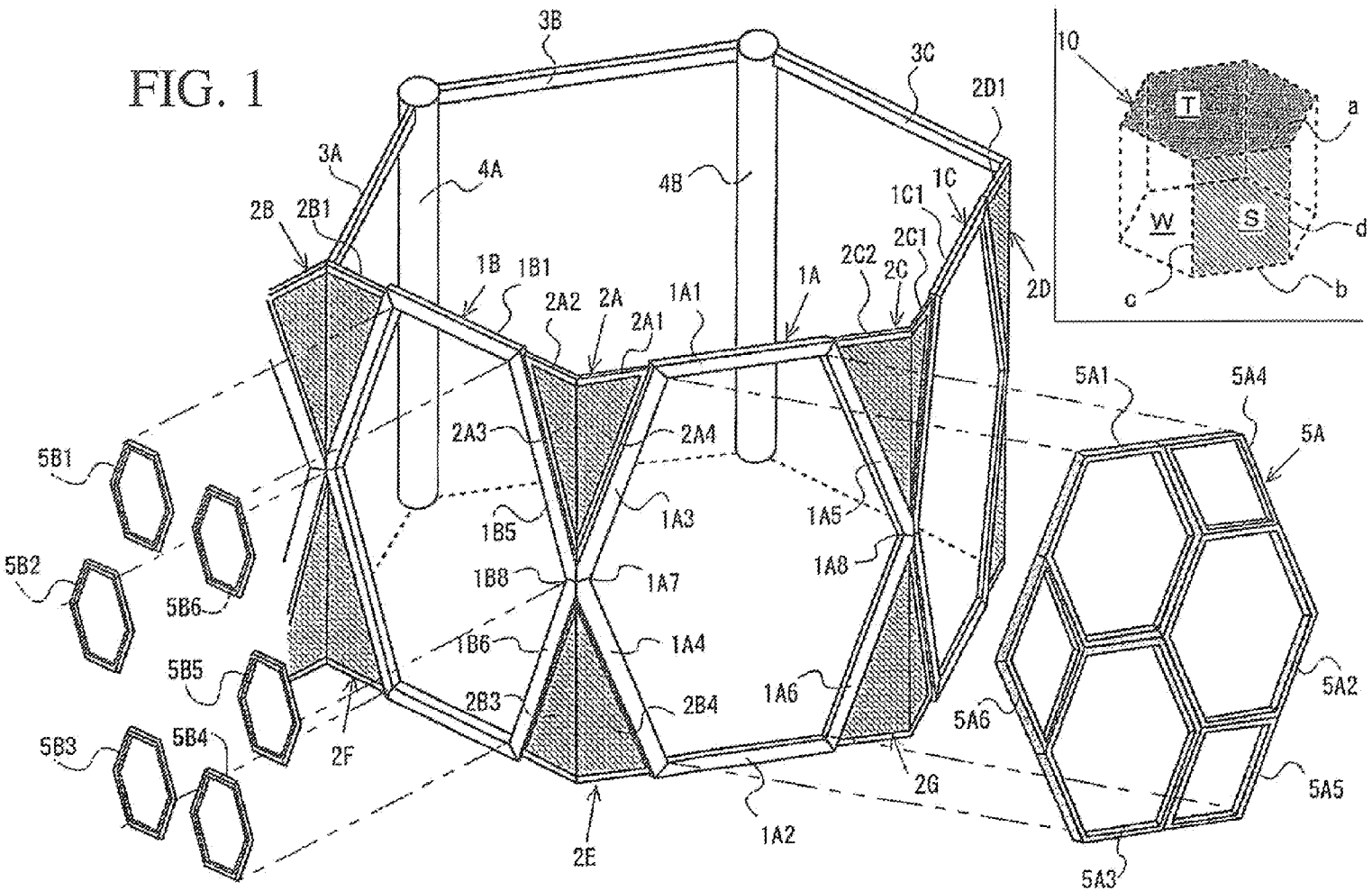
FIG. 1 is a perspective developed view of a part of a building structure according to an embodiment of the present invention.

FIG. 1 is a perspective developed view of a part of a building structure according to an embodiment of the present invention and a polygonal prism shown by broken lines in the upper-right drawing is a virtual unit space 10. A building structure according to the present invention has a whole shape formed by connecting a plurality of such unit spaces 10 at least horizontally, and the whole shape will be later described in FIG. 6.

The unit space 10 is a basic unit defining a shape of the building structure according to the present invention. A practical building structure is constructed, as shown in the middle of FIG. 1, by joining a specified structural member to each side and/or each face of the unit space 10.

Since the structure of each unit space 10 has common characteristics, specified structural members provided in one unit space 10 will be first described using FIG. 1.

The unit space 10 of the polygonal prism shown at the upper right has a pair of upper end face T and lower end face W and six side faces S. The end faces T and W each have the same size and a regular hexagonal edge in the example. One side face S has an upper side a, a lower side b, a left side c and a right side d, the six side faces S each have the same size in the example and the upper side a is also an edge of the end face T. The height of the unit space 10 is optionally set, and as another example, the end faces T and W each have to be not necessarily a regular hexagon.

The unit space (larger than the upper-right drawing) in the middle of FIG. 1 has three outdoor side faces in front and three indoor side faces behind. The three outdoor side faces each include a main hexagonal frame 1A, 1B, 1C standing along them.

The main hexagonal frame 1A is a hexagonal grid constituted by an upper-side member 1A1, a lower-side member 1A2, an upper-left-side member 1A3, a lower-left-side member 1A4, an upper-right-side member 1A5 and a lower-right-side member 1A6. The upper-side member 1A1 and the lower-side member 1A2 are arranged on the upper side a and the lower side b of a side face S of the unit space 10, a bend portion 1A7 at the joint of the upper-left-side member 1A3 and the lower-left-side member 1A4 are arranged on the left side c of the side face S of the unit space and a bend portion 1A8 at the joint of the upper-right-side member 1A5 and the lower-right-side member 1A6 are arranged on the right side d of the side face S of the unit space.

Similarly to the main hexagonal frame 1A, the main hexagonal frames 1B and 1C are arranged in the corresponding side faces of the unit space. The bend portion 1A7 of the main hexagonal frame 1A is joined to a bend portion 1B8 of the main hexagonal frame 1B.

In the example of FIG. 1, the main hexagonal frame is a regular hexagon, however not limited to this, and hence, it may be a hexagon which is at least laterally symmetrical.

A bent triangular frame 2A is arranged between the upper-left-side member 1A3 of the main hexagonal frame 1A and an upper-right-side member 1B5 of the main hexagonal frame 1B and joined to them. The bent triangular frame 2A is shaped by bending an isosceles triangle along the median line, and in the example of FIG. 1, provided with optional panels 2A3 and 2A4 fitted therein.

The bent upper-side member of the bent triangular frame 2A forms edge beams 2A1 and 2A2. Similarly, the upper sides of the outdoor side faces are provided with an edge beam 2B1 of a bent triangular frame 2B (whose left half is included in the adjacent unit space), edge beams 2C1 and 2C2 of a bent triangular frame 2C and an edge beam 2D1 of a bent triangular frame 2D (whose right half is shown). The edge beams 2A1, 2A2, 2B1, 2C1, 2C2 and 2D1 are arranged in the place not occupied by the upper-side members 1A1, 1B1 and 1C1 of the three main hexagonal frames.

On the other hand, edge beams 3A, 3B and 3C are provided along the indoor edge of the upper end face T of the unit space 10.

Over the entire edge of the upper end face T of the unit space 10, the edge beams 2A1, 2A2, 2B1, 2C1, 2C2, 2D1, 3A, 3B and 3C as well as the upper-side members 1A1, 1B1 and 1C1 of the main hexagonal frames are arranged and joined together to thereby form a hexagonal beam.

Further, indoor pillars 4A and 4B stand indoors which are each a straight pillar and arranged on each indoor side among the left sides c and the right sides d of the side faces of the unit space 10, in other words, along each indoor corner of the unit space 10. The indoor pillar 4A is joined at the top to the ends of the edge beams 3A and 3B and the indoor pillar 4B is joined at the top to the ends of the edge beams 3B and 3C. The indoor pillars 4A and 4B shown in the figure are each a circular cylinder, but this is an example and the sectional shape thereof is not limited to a circle.

If the unit spaces 10 are horizontally connected, adjacent unit spaces share the indoor edge beams 3A, 3B and 3C and the indoor pillars 4A and 4B.

As described so far, the building structure according to the present invention basically has a whole shape formed by connecting unit spaces each having a polygonal-prism shape and includes main hexagonal frames standing in the peripheral surface thereof, edge beams in the upper end face and straight pillars in the indoor corners which are joined together.

In order to secure more free space indoors, preferably, no main hexagonal frame may be provided in the indoor side faces. However, if a main hexagonal frame is provided indoors, the building structure can be reinforced, and if necessary, one or a plurality of main hexagonal frames (not shown) may be provided indoors. Providing main hexagonal frames indoors can save unnecessary indoor pillars. Besides, if an indoor main hexagonal frame includes no upper-side member, then it is provided at the place with an edge beam, if necessary. In other words, even if a main hexagonal frame is provided indoors, either an edge beam or an upper-side member of the main hexagonal frame is provided along an edge of the upper end face of each unit space to thereby form a hexagonal beam.

In FIG. 1, each bent triangular frame 2E, 2F, 2G with a panel is fitted into a lower-half space between adjacent main hexagonal frames. Although they are optional members, it is preferable that each bent lower-side member of the bent triangular frames 2E, 2F and 2G is at least joined to the lower-side member 1A2 or the like of a main hexagonal frame, thereby enhancing the structural strength.

Figure 2:
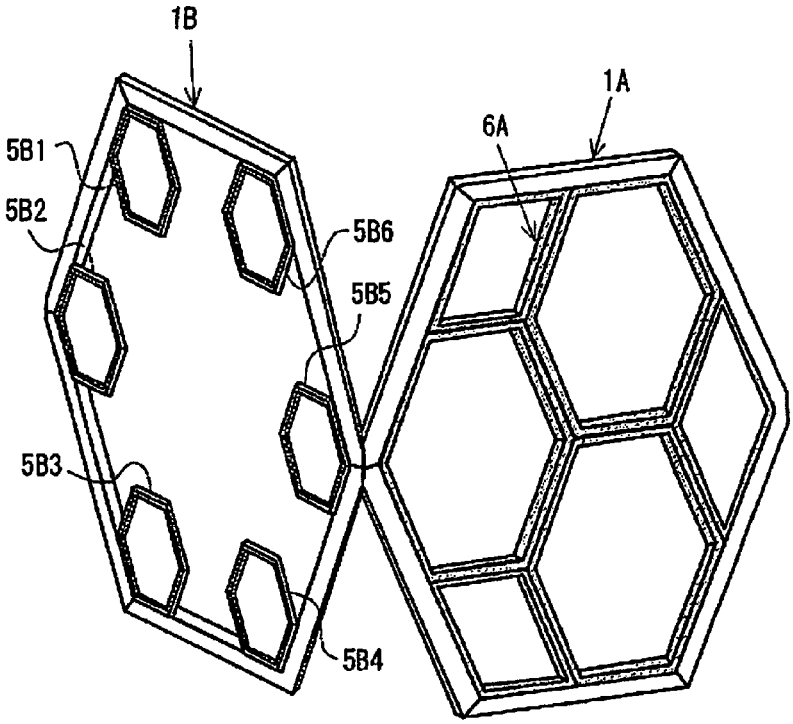
FIG. 2 is a perspective view of main hexagonal frames and sub-frames attached thereto.

As shown in FIG. 1, the main hexagonal frame 1A, 1B or the like may be provided inside with a sub-frame 5A, or 5B1 to 5B6. FIG. 2 is a perspective view of the main hexagonal frame 1A with the sub-frame 5A attached thereto and the main hexagonal frame 1B with the sub-frames 5B1 to 5B6 attached thereto.

The sub-frames rigidify a main hexagonal frame, thereby improving the stability and earthquake proof of the building structure. Particularly, the rigid zone around a vertex of a main hexagonal frame enlarges, thereby strengthening the vertex and its vicinity against a deformation or bending-moment stress.

As shown in FIG. 1, the sub-frame 5A is a complex frame constituted by a plurality of frame members and is closely fitted into the main hexagonal frame 1A. The plurality of frame members are three sub-hexagonal frames 5A1, 5A2 and 5A3 and three rhombic frames 5A4, 5A5 and 5A6. Each sub-hexagonal frame is similar to the main hexagonal frame 1A and has a similitude ratio of approximately ½ in the example. Further, the three sub-hexagonal frames are joined together into a honeycomb shape and the rhombic frames fill the gaps between the sub-hexagonal frames and the main hexagonal frame.

The similitude ratio of each sub-hexagonal frame 5A1 or the like to the main hexagonal frame 1A is not limited to ½, and for example, may be approximately ⅓ or ¼. Herein, "approximately" is given because each frame has a finite thickness and hence has a difference in inside and outside dimensions. As the similitude ratio lowers, more sub-hexagonal frames are necessary for filling the main hexagonal frame with a honeycomb shape.

On the other hand, the sub-frames 5B1 to 5B6 attached to the main hexagonal frame 1B are apart from each other and are each a sub-hexagonal frame similar to the main hexagonal frame 1B. Each sub-hexagonal frame is brought into contact with the inside (called a "vertex position") of each vertex of the main hexagonal frame 1B and joined thereto. The similitude ratio is optional, and the sub-frames may be attached to only some of the six vertexes (e.g., both ends of the upper and lower sides).

The sub-frame 5A, or 5B1 to 5B6 shown in FIGS. 1 and 2 is merely an example, and hence, the sub-frame includes numerous variations. For example, the sub-hexagonal frame 5A1 or 5B1 is provided inside with one or a plurality of hexagonal frames which are smaller and similar thereto. Preferably, the plurality of inside hexagonal frames having the same dimensions may be joined together into a honeycomb shape.

All the above sub-frames rigidify the main hexagonal frame, and each may be optionally provided inside with an appropriate panel and can be reinforced by selecting a proper material for the panel.

In addition, each sub-frame can be also used as a window frame and meet demands for a variety of designs.

The materials of the main hexagonal frames, edge beams, indoor pillars and sub-frames shown in FIGS. 1 and 2 are not especially limited, and for example, each may be a steel frame (stainless steel), reinforced concrete (RC), precast concrete (PC) or wood.

Figure 3:
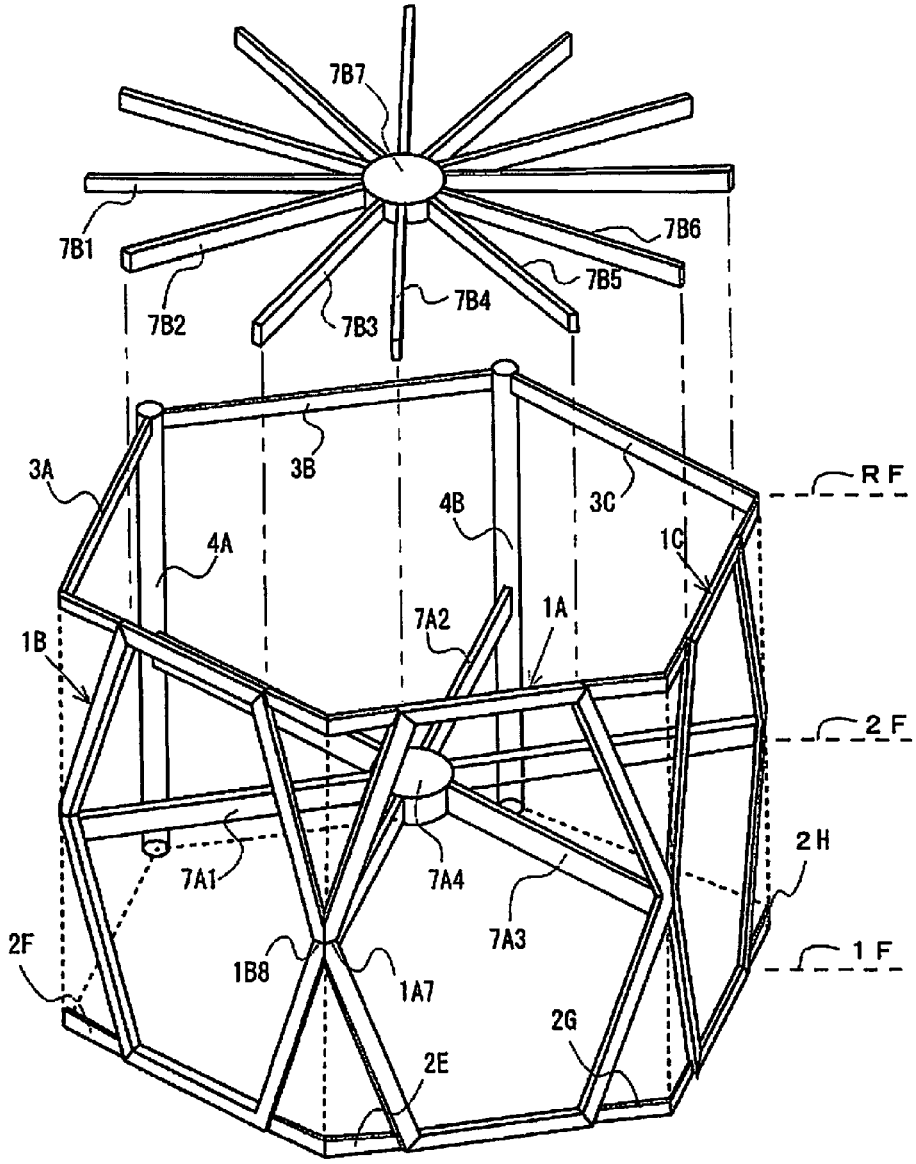
FIG. 3 is a perspective developed view of the building structure shown in FIG. 1 further provided with inner beams.

FIG. 3 is a perspective developed view of the building structure shown in FIG. 1 further provided with inner beams. In the example of FIG. 3, the unit space as the building structure has a height for two story layers and includes a first floor 1F on the bottom plane, a second floor 2F on the middle horizontal plane, a roof floor RF on the top plane. Alternatively, the unit space may include only one story layer or three story layers. Further, two unit spaces each including two story layers are vertically placed one on top of the other to thereby construct a building having four story layers and two unit spaces each including three story layers are vertically placed one on top of the other to thereby construct a building having six story layers.

The second floor 2F of FIG. 3 is provided with three inner beams 7A1, 7A2 and 7A3 intersecting each other at the midpoint and radiating from there, and a support member 7A4 supporting the intersection point thereof. Both ends of each inner beam are each joined to a bend portion of the main hexagonal frame 1A, 1B or 1C, or the indoor pillar 4A or 4B.

The roof floor RF is provided with six inner beams 7B1 to 7B6 intersecting each other at the midpoint and radiating from there, and a support member 7B7 supporting the intersection point thereof. Both ends of each inner beam are each joined to an end of the upper-side member of the main hexagonal frame 1A, 1B or 1C, or the indoor edge beam 3A, 3B or 3C.

As described above, it is preferable that the inner beams 7A1 to 7A3 and 7B1 to 7B6 arranged across the unit space are each joined to any of the principal structural members (main hexagonal frames, edge beams and indoor pillars). However, each of them may be joined to any sub-frame shown in FIGS. 1 and 2, if permitted.

Preferably, the unit space may be provided under the bottom plane (first floor) with footing beams (not shown), for example, having the same shape as the six inner beams 7B1 to 7B6 located in the roof floor RF. In this case, both ends of the footing beams are joined to the lower-side members of the main hexagonal frames 1A, 1B and 1C, the legs of the indoor pillars 4A and 4B, the lower-side members of the bent triangular frames 2E, 2F, 2G and 2H and the like.

The materials of the inner beams and footing beams are not especially limited, and for example, each may be a steel frame, RC, PC or wood.

Figure 4A:
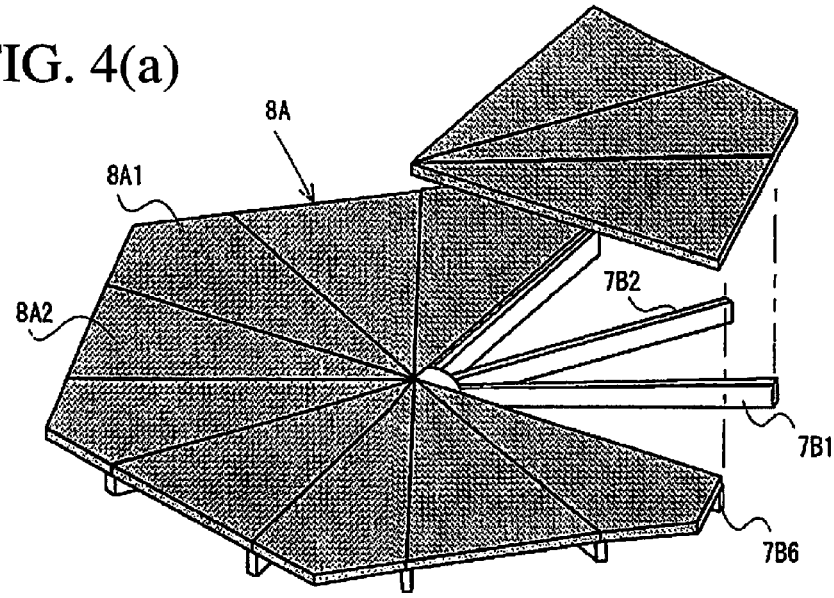
FIGS. 4A and 4B are each a perspective developed view of a slab provided over the inner beams arranged in a roof floor RF shown in FIG. 3.

FIG. 4A is a perspective developed view of a slab 8A provided over the inner beams 7B1 to 7B6 of the roof floor RF shown in FIG. 3. The slab 8A is formed, for example, by combining a plurality of PC slab pieces 8A1 and 8A2 each having an appropriate shape. As is not shown in any figure, such a slab may also be provided over the inner beams 7A1 to 7A3 of the second floor 2F shown in FIG. 3.

Figure 4B:
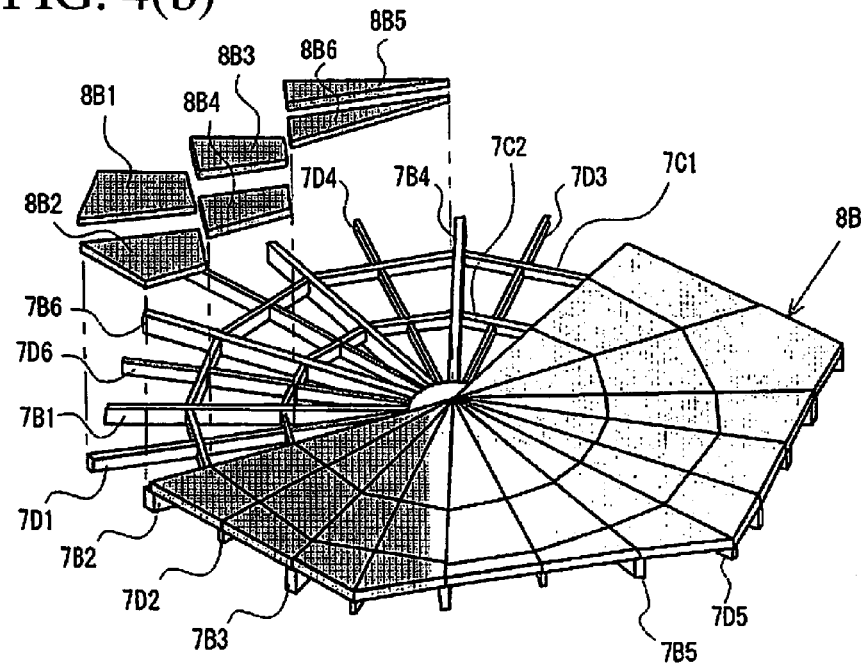

FIG. 4B is a perspective developed view showing inner beams and a slab in another example. In FIG. 4B, two first reinforcing members 7C1 and 7C2 are provided circumferentially across between the adjacent inner beams 7B1 and 7B2 or the like, and hence, have a circumferential shape. Further, second reinforcing members 7D1 to 7D6 are provided in the radial directions between the adjacent inner beams 7B1 and 7B2 or the like. The inner beams, first reinforcing members and second reinforcing members are joined together and may preferably be made of stainless steel. The thus formed stronger and solider beams are helpful in using a light member such as a wooden board as the slab placed thereon. Besides, in this case, slab pieces 8B1 to 8B6 are relatively small, thereby improving the productivity, the workability or the like. In another example, only the first reinforcing members 7C1 and 7C2 in the circumferential directions may be arranged without the second reinforcing members 7D1 to 7D6 in the radial directions. Although the first reinforcing members are a double circle merely as an example in FIG. 4B, more circles may be provided if necessary.

FIGS. 4A and 4B show rough configurations of the slab, and if necessary, a member having a heat-insulating layer and/or a sound-insulating layer, or another kind of function may be further provided as the slab. Particularly, a roof member can be further provided which includes a water-proofing layer and/or a moisture-proofing layer, or the like.

The inner beams and slabs shown in FIGS. 3, 4A and 4B may be provided partly in the whole of a horizontal plane inside of the unit space, thereby forming an open ceiling or a staircase in the part including neither such inner beams nor slab. The building structure according to the present invention can be basically supported by the principal structural members (main hexagonal frames, edge beams and indoor pillars) shown in FIG. 1, thereby determining the arrangement and shapes of the inner beams and slab suitably in line with an indoor design.

As shown in FIGS. 3, 4A and 4B, the inner beams are provided and the slab are over them, thereby strengthening the unit space structurally and the whole building structure.

Figure 5:
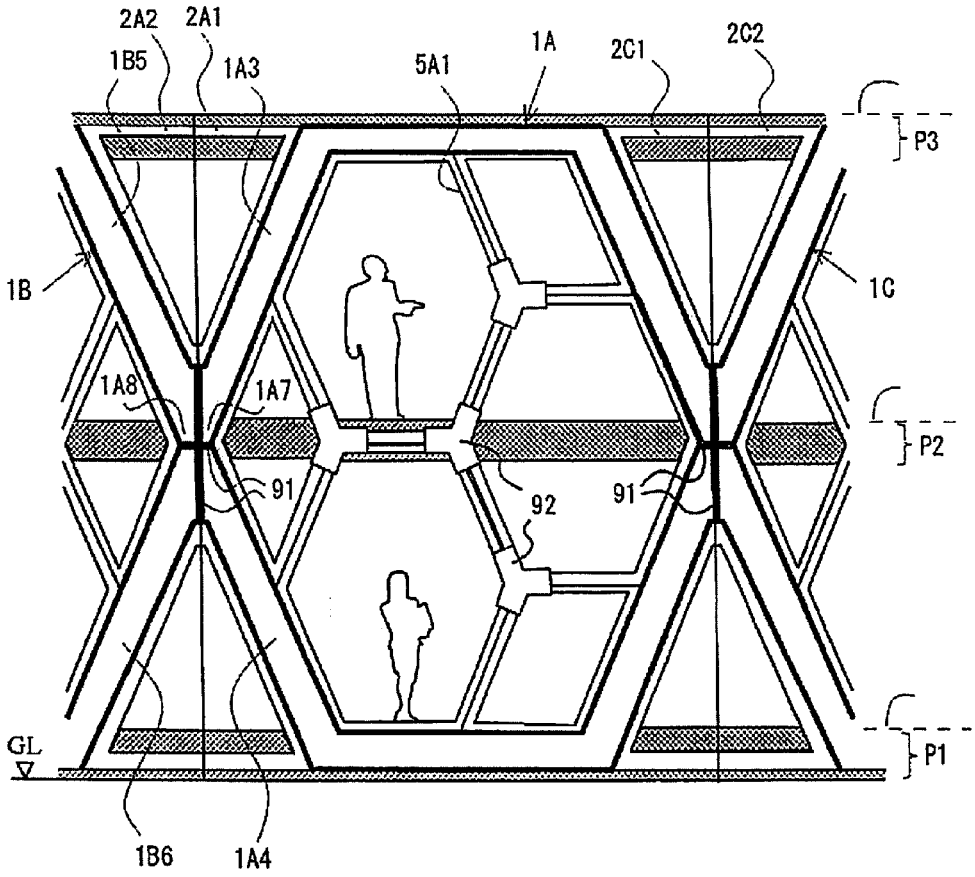
FIG. 5 is a schematic partial side view of the building structure shown in FIGS. 1 to 4.

FIG. 5 is a schematic partial side view of the building structure shown in FIGS. 1 to 4A and 4B. In the example, the main hexagonal frames 1A, 1B and 1C are formed with H-shaped steel, the cut surfaces of the H-shaped steel are joined together at the joint of the bend portions 1A7 and 1A8 and a cruciform reinforcing steel 91 is attached there to thereby secure a predetermined strength. The juncture of the stainless steel is conducted by a bolt or welding.

The sub-frame 5A1 or the like may be formed with steel having a smaller sectional area than the main hexagonal frame 1A or the like. As shown in the figure, the sub-frames are joined, for example, by covering the joint with a Y-shaped joint member 92 and using a bolt or welding. The first floor 1F, the second floor 2F and the roof floor RF are provided beneath with spaces P1, P2 and P3, respectively, each having a predetermined thickness where the above slab and inner beams as well as a specified sub-floor space or ceiling space, another building member or the like can be arranged and for example, including piping or electric wiring. Particularly, the inner beams are made of stainless steel to thereby enlarge the spaces.

FIGS. 6A to 6D are schematic perspective views showing a whole shape of the building structure according to the present invention. In the example, five unit spaces each having a polygonal-prism shape are horizontally connected to form a whole shape. As is not strict, in FIGS. 6A to 6D, thick solid lines indicate main hexagonal frames; thin solid lines, edge beams, inner beams, sub-frames or bent lines of bent triangular frames; and thin broken lines, some of them covered with roof members and thereby directly unseen. Gray parts indicate that panels, roof members or the like are arranged while white parts indicate that no panels, roof members or the like are arranged (also applied to FIG. 7). In the figures, underlined F, B, R and L denote the front, back, right and left of the building structure, respectively, and thereby, FIGS. 6A to 6D are each a perspective view seen from the four directions of the building structure.

The adjacent unit spaces share a side face and are mutually connected, and as is not shown in any figure, if unit spaces are vertically connected, they share an end face by using an upper end face and a lower end face thereof in common.

A reference numeral 10 denotes a unit space having the basic structure of FIGS. 1 to 5 while a reference numeral 11 or 12 denotes a unit space having a structure according to a variation. In the unit space 11, main hexagonal frames are provided only in apart of the lower half while few frames and beams are provided in the upper half to thereby form an open space. In the unit space 12, main hexagonal frames are provided only in the upper half of a part of the side faces. Any building structures formed by connecting the unit spaces according to the variations can also be implemented within the scope of the present invention.

A roof member may be made of PC or RC, and further, a folded plate may be laid on stainless-steel beams. Alternatively, a glass plate may be fitted between beams, and in this case, the beams are supposed to appear on the exterior.

Although FIG. 6 shows an example where a plurality of unit spaces each having the same shape are connected, as another example, unit spaces each having a polygonal-prism shape different in height can be connected. For example, a polygonal-prism unit space having a height of ½ is provided, thereby realizing a whole shape in which a roof floor has a difference in level, or even if only unit spaces each having the same shape are connected, a different number of unit spaces are vertically placed on top of one another, thereby realizing a whole shape in which a roof floor has a difference in level.

Figure 7A:
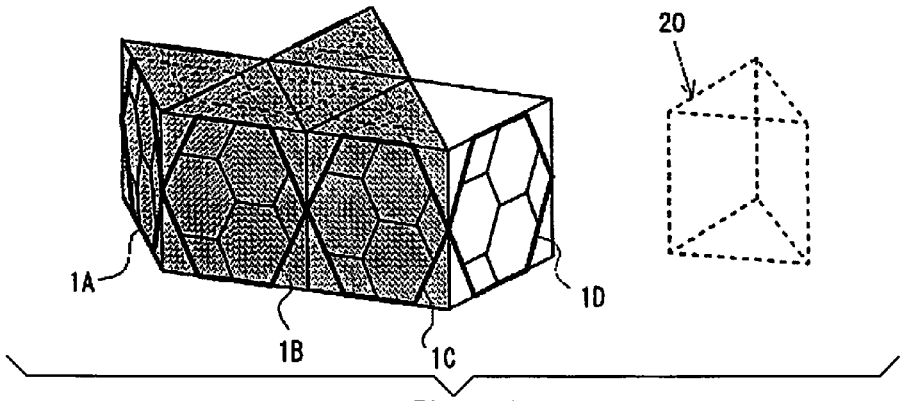
FIGS. 7A to 7C are each a perspective view of each building structure according to another embodiment of the present invention.
Figure 7B:
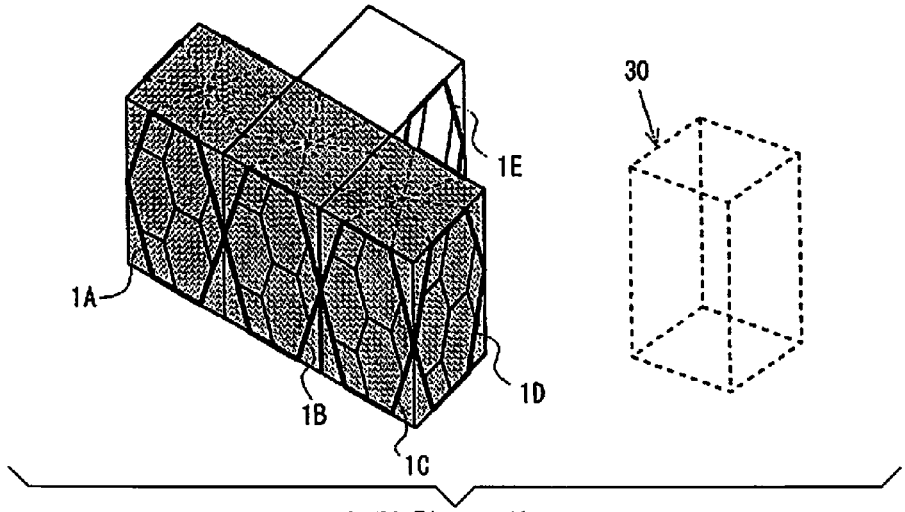
Figure 7C:
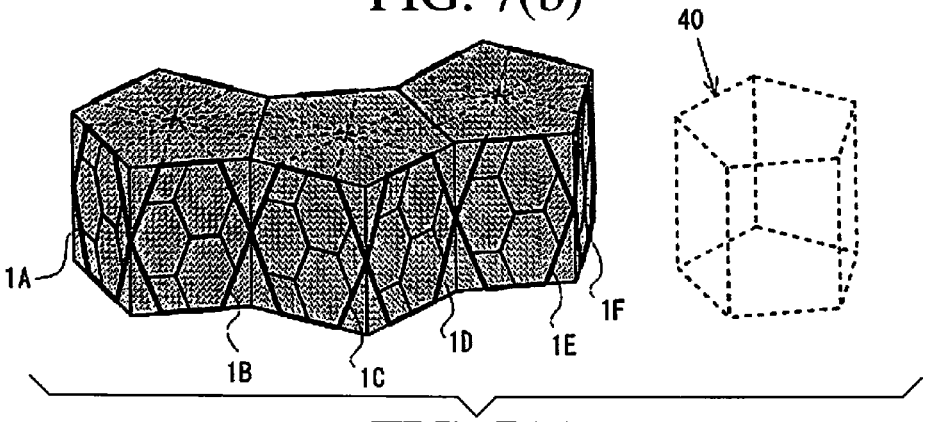

FIGS. 7A to 7C are each a perspective view of each building structure according to another embodiment of the present invention. In each figure, the left drawing shows a whole shape of the building structure and the broken lines on the right shows the shape of each unit space—a triangular prism 20, a quadrangular prism 30 and a pentagonal prism 40. Although each unit space has a different shape, each structural member is arranged in the same way as the basic form in the hexagonal prism shown in FIG. 1.

In FIG. 7A, six triangular-prism unit spaces 20 are horizontally connected and main hexagonal frames 1A to 1D or the like stand along the outdoor side faces. In FIG. 7B, four quadrangular-prism unit spaces 30 are horizontally connected and main hexagonal frames 1A to 1E or the like stand along the outdoor side faces. In FIG. 7C, three pentagonal-prism unit spaces 40 are horizontally connected and main hexagonal frames 1A to 1F or the like stand along the outdoor side faces.

As shown in FIGS. 7A and 7B, the plurality of unit spaces are connected in the single direction and thereby form a roof floor horizontally extending relatively long. In this case, for example, roof members laid in the individual unit spaces may be replaced with a long roof member (e.g., a folded plate or the like) covering all the plurality of unit spaces together.

As shown in FIGS. 7A to 7C, each unit space constituting a whole shape of the building structure according to the present invention is not limited to a hexagonal prism and maybe a polygonal prism having another shape. Besides, the end faces of a polygonal prism each not necessarily have a regular-polygon shape, as long as the polygonal prisms can be horizontally connected without any gap.

DESCRIPTION OF THE SYMBOLS

1A, 1B, 1C, 1D, 1E, 1F: main hexagonal frame
2A, 2B, 2C, 2D, 2E, 2F, 2G, 2H: bent triangular frame
2A1, 2A2, 2B1, 2C1, 2C2, 2D1: edge beam
3A, 3B, 3C: edge beam
4A, 4B: indoor pillar
5A: complex frame
5A1, 5A2, 5A3: sub-hexagonal frame
5A4, 5A5, 5A6: rhombic frame
5B1, 5B2, 5B3: sub-hexagonal frame
7A1 to 7A3, 7B1 to 7B6: inner beam
7C1, 7C2, 7D1 to 7D6: reinforcing member
8A: slab
8A1, 8A2: PC slab piece
8B1 to 8B2: wooden-board piece
91: reinforcing steel
92: joint member
10, 20, 30, 40: unit space

What is claimed is:

1. A building structure which has a whole shape formed by connecting at least horizontally a plurality of unit spaces (10) each in the shape of a polygonal prism having a pair of upper and lower end faces (T, W) defining roof and floor regions respectively, and a plurality of indoor and outdoor facing side faces (S), the unit spaces sharing a side face if horizontally adjacent to each other and sharing an end face if vertically adjacent to each other, comprising:

a main hexagonal frame (1A, 1B, 1C) standing in each outdoor side face among the side faces (S) of each unit space;

an edge beam (2A1, 2A2, 2B1, 2C1, 2C2, 2D1, 3A, 3B, 3C) arranged at an edge of the upper end face (T) of each unit space that is not occupied by a member of the main hexagonal frame;

an indoor pillar (4A, 4B) arranged on each indoor side face among the left sides (c) and right sides (d) of the side faces (S) of each unit space, the indoor pillar extending continuously from the roof region to the floor region so as to provide support for the building structure;

an upper side (1A1) and a lower side (1A2) of the main hexagonal frame, the upper side (1A1) and the lower side (1A2) of the main hexagonal frame are located on an upper side (a) and a lower side (b) of the outdoor side face, respectively; and are generally planar with the roof and floor regions, respectively;

left and right bend portions (1A7, 1A8) of the main hexagonal frame, each bend portion having a vertex; the left and right bend portions of the main hexagonal frame are located on a left side (c) and a right side (d) of the outdoor side face, respectively whereby the left and right bend portions of each outdoor side face are joined at their vertices to the vertices of the right and left bend portions respectively of an adjacent outdoor side face; and the main hexagonal frame, the edge beam and the indoor pillar are joined to each other.

2. The building structure according to claim 1, wherein the main hexagonal frame (1A) is provided inside with one or a plurality of sub-hexagonal frames (5A1, 5B1) similar to the main hexagonal frame, and the one or the plurality of sub-hexagonal frames is joined to the main hexagonal frame in any vertex position of the main hexagonal frame.

3. The building structure according to claim 2, wherein at least the one or a plurality of the sub-hexagonal frames arranged inside of the main hexagonal frame are joined together into a honeycomb shape and fitted into the main hexagonal frame.

4. The building structure according to claim 1 and further comprising an indoor main hexagonal frame standing in the one or a plurality of indoor side faces among the side faces (S) of each unit space.

5. The building structure according to claim 1 and wherein each unit space is provided with a plurality of inner beams (7A1, 7A2, 7A3, 7B1-7B6) horizontally arranged across the unit space.

6. The building structure according to claim 5, wherein a slab (8) is provided on the inner beams.

7. The building structure according to claim 6, wherein in one or a plurality of unit spaces, the inner beams and the slab are arranged partly in the whole of a horizontal plane inside of each unit space.

8. The building structure according to claim 1 and wherein the unit space includes two story layers or three story layers.

9. The building structure according to claim 1 and wherein the unit space has a hexagonal-prism shape.

10. The building structure according to claim 1 and wherein the unit space has any shape of a pentagonal prism, a quadrangular prism, or a triangular prism.

* * * * *